US008502814B2

(12) United States Patent
Seto

(10) Patent No.: US 8,502,814 B2
(45) Date of Patent: Aug. 6, 2013

(54) PIXEL CIRCUIT AND DISPLAY APPARATUS

(75) Inventor: Yasuhiro Seto, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 649 days.

(21) Appl. No.: 12/412,063

(22) Filed: Mar. 26, 2009

(65) Prior Publication Data

US 2009/0244057 A1 Oct. 1, 2009

(30) Foreign Application Priority Data

Mar. 26, 2008 (JP) ..... 2008-079795

(51) Int. Cl.
*G09G 5/00* (2006.01)
*G09G 3/36* (2006.01)

(52) U.S. Cl.
USPC ..... 345/214; 345/92

(58) Field of Classification Search
None
See application file for complete search history.

(56) References Cited

U.S. PATENT DOCUMENTS 5,684,365 A 11/1997 Tang et al.
6,919,868 B2 * 7/2005 Tam ..... 345/76
7,379,039 B2 * 5/2008 Yumoto ..... 345/82
7,414,600 B2 * 8/2008 Nathan et al. ..... 345/82
7,569,849 B2 * 8/2009 Nathan et al. ..... 257/40
7,995,008 B2 * 8/2011 Miwa ..... 345/76

FOREIGN PATENT DOCUMENTS

JP 2003-255856 A 9/2003
JP 2008-009275 A 1/2008

OTHER PUBLICATIONS

Chang Jung Kim, et al., "Highly Stable $Ga_2O_3$-$In_2O_3$-ZnO TFT for Active-Matrix Organic Light-Emitting Diode Display Application", IEDM (International Electron Device Meeting) 2006, Samsung Advance Institute of Technology, 4 pages.
Japanese Office Action dated Apr. 17, 2012 in corresponding Japanese Application No. 2008-079795.

* cited by examiner

*Primary Examiner* — K. Wong
(74) *Attorney, Agent, or Firm* — Sughrue Mion, PLLC

(57) ABSTRACT

A pixel circuit including a light emitting element, a driving transistor, with a drain terminal thereof connected to a cathode terminal of the light emitting element, that applies a drive current to the light emitting element, a capacitor element connected to a gate terminal of the driving transistor, and a switching transistor connected between a first terminal of the capacitor element on the side of the gate terminal and a data line through which a desired program signal flows, in which the driving transistor is an inorganic oxide thin film transistor whose OFF-operation threshold voltage is a negative voltage, and a source terminal of the driving transistor and a second terminal of the capacitor element are connected to a common power source that supplies a predetermined common voltage.

8 Claims, 4 Drawing Sheets

PIXEL CIRCUIT AND DISPLAY APPARATUS

BACKGROUND OF THE INVENTION

1. Field of the Invention

The present invention generally relates to a pixel circuit and display apparatus having a light emitting element driven by active matrix method, and more particularly to a pixel circuit using an inorganic oxide thin film transistor.

2. Description of the Related Art

Display devices using light emitting elements, such as organic EL element and the like, are proposed for use in various fields including televisions, cell phone displays, and the like.

Generally, the organic EL element is a current-driven type light emitting element, thus pixel circuits including an organic EL element proposed have a configuration like that shown in FIG. 9 as described, for example, in U.S. Pat. No. 5,684,365.

The pixel circuit shown in FIG. 9 includes switching transistor 104, capacitor element 103, and driving transistor 102 as a minimum configuration. In the configuration, when switching transistor 104 is turned ON, a program signal, which will serve as a gate voltage of driving transistor 102, is written in capacitor element 103, and the gate voltage according to the program signal is applied to driving transistor 102 so as to perform constant current operation, whereby a drive current flows through organic EL element 101 and light is emitted from the device.

In conventional pixel circuits, low-temperature polysilicon or amorphous silicon thin film transistors are used as the switching transistor and driving transistor.

The low-temperature polysilicon thin film transistor may provide high mobility and high stability of threshold voltage, but has a problem that the mobility is not uniform. The amorphous silicon thin film transistor may provide uniform mobility, but has a problem that the mobility is low and threshold voltage varies with time. The non-uniform mobility and instable threshold voltage appear as irregularities in the display image.

Consequently, Japanese Unexamined Patent Publication No. 2003-255856 proposes a pixel circuit having therein a compensation circuit for correcting the threshold voltage.

The provision of the compensation circuit, however, causes the pixel circuit to become complicated, resulting in increased cost due to low yield rate and low aperture ratio.

As such, thin film transistors made of inorganic oxide films, as typified by IGZO, have recently been drawing attention. The thin film transistors made of inorganic oxide films allow low-temperature film forming and have features of providing sufficient mobility, highly uniform mobility, and low threshold voltage variation with time.

Where thin film transistors are fabricated with inorganic oxide films in order to obtain various desired characteristics and when trying to obtain desired current characteristics, however, the threshold voltage that causes the transistors to perform OFF operation may sometimes become a negative voltage.

For example, when trying to control a thin film transistor, used as the driving transistor whose OFF-operation threshold voltage is a negative voltage like that described, for example, "Highly Stable $Ga_2O_3$—$In_2O_3$—ZnO TFT for Active-Matrix Organic Light-Emitting Diode Display Application", C. J. Kim et al., IEDM (International Electron Device Meeting) 2006, Samsung Advanced Institute of Technology (Non-Patent Document 1) by the data driving circuit of a conventional organic EL display device, the minimum setup value of the gate voltage of the driving transistor of the conventional data driving circuit is 0 v, so that a minimum drive current, which is the value when gate-source voltage VGS of the driving transistor is 0 v, flows through the organic EL element, thus unable to cause the EL element to stop the emission.

FIG. 10 shows voltage waveforms of scan signal, data signal, and gate-source voltage VGS of driving transistor 102 when the thin film transistor described in Non-Patent document 1 is used in the pixel circuit shown in FIG. 9.

Use of a thin film transistor whose OFF-operation threshold voltage is a negative voltage as driving transistor 102 results in that driving transistor 102 is unable to perform OFF operation as shown in FIG. 10, therefore unable to cause organic EL element to stop the emission, causing difficulties in emission control in a low brightness region.

In order to solve the problems described above, it is conceivable to provide a voltage source to set the ground wire of the pixel circuit at a voltage (VA) higher than 0 v, as shown in FIG. 10. But this method greatly increases power consumption of the display device as a whole, whereby the feature of low power consumption of EL element is spoiled.

It is also conceivable to set the ground wire of the data drive circuit that supplies a program signal at a voltage higher than 0 v, thereby causing the program signal to become negative. But in order to ensure the data connection level with an external device, it is necessary to newly develop a dedicated IC, which becomes a cost increase factor of the display device.

In view of the circumstances described above, it is an object of the present invention to provide a pixel circuit that uses an inorganic oxide thin film transistor whose OFF-operation threshold voltage is a negative voltage, yet does not increase power consumption and allows the use of a conventional drive circuit, and a display apparatus that uses the pixel circuit.

SUMMARY OF THE INVENTION

A first pixel circuit of the present invention is a circuit including:

a light emitting element;

a driving transistor, with a drain terminal thereof connected to a cathode terminal of the light emitting element, that applies a drive current to the light emitting element;

a capacitor element connected to a gate terminal of the driving transistor; and a switching transistor connected between a first terminal of the capacitor element on the side of the gate terminal and a data line through which a desired program signal flows, wherein:

the driving transistor is an inorganic oxide thin film transistor whose OFF-operation threshold voltage is a negative voltage; and a source terminal of the driving transistor and a second terminal of the capacitor element are connected to a common power source that supplies a predetermined common voltage.

A first display apparatus of the present invention is an apparatus, including:

an active matrix substrate on which the first pixel circuit of the present invention described above is disposed in a large number;

a data drive circuit that supplies the program signal; and a common power source that supplies a predetermined voltage to the source terminal of the driving transistor and the second terminal of the capacitor element, wherein a voltage value VB of the common voltage and a voltage value $V_{prg}$ of the program signal are set such that the threshold voltage VTH, the voltage value VB of the common voltage, the voltage value $V_{prg}$ of the program signal, and a desired gate-source voltage VGS to be set for the driving transistor satisfy the relationships of Formulae (1) and (2) below.

$$VB \geqq -VTH \quad (1)$$

$$V_{prg} = VGS - VB \quad (2)$$

A second pixel circuit of the present invention is a circuit, including:

a light emitting element;

a driving transistor, with a source terminal thereof connected to an anode terminal of the light emitting element, that applies a drive current to the light emitting element;

a capacitor element connected to a gate terminal of the driving transistor; and a switching transistor connected between a first terminal of the capacitor element on the side of the gate terminal and a data line through which a desired program signal flows, wherein:

the driving transistor is an inorganic oxide thin film transistor whose OFF-operation threshold voltage is a negative voltage; and a cathode terminal of the light emitting element and a second terminal of the capacitor element are connected to a common power source that supplies a predetermined common voltage.

A second display apparatus of the present invention is an apparatus, including:

an active matrix substrate on which the second pixel circuit of the present invention described above is disposed in a large number;

a data drive circuit that supplies the program signal; and a common power source that supplies a predetermined voltage to the source terminal of the driving transistor and the second terminal of the capacitor element, wherein a voltage value VB of the common voltage and a voltage value $V_{prg}$ of the program signal are set such that the threshold voltage VTH, the voltage value VB of the common voltage, the voltage value $V_{prg}$ of the program signal, a desired gate-source voltage VGS to be set for the driving transistor, and a forward voltage drop Vf across the light emitting element when the gate-source voltage of the driving transistor is VGS satisfy the relationships of Formulae (3) and (4) below.

$$VB \geqq -VTH \quad (3)$$

$$V_{prg} = VGS - VB + Vf \quad (4)$$

According to the first pixel circuit and display apparatus of the present invention, an inorganic oxide thin film transistor whose OFF-operation threshold voltage is a negative voltage is used as the driving transistor, and a source terminal of the driving transistor and a terminal of the capacitor element are connected to a common power source that supplies a predetermined common voltage. This enables a negative voltage to be applied between the gate and source of the driving transistor to cause the transistor to perform OFF operation even when the program signal is a positive voltage by supplying the common voltage while the capacitor element is being charged, which allows appropriate emission control in a low brightness region. Further, a conventional data drive circuit that outputs a program signal of positive voltage may be used without increasing power consumption.

According to the second pixel circuit and display apparatus of the present invention, an inorganic oxide thin film transistor whose OFF-operation threshold voltage is a negative voltage is used as the driving transistor, and a cathode terminal of the light emitting element connected to a source terminal of the driving transistor and a terminal of the capacitor element are connected to a common power source that supplies a predetermined common voltage. This enables a negative voltage to be applied between the gate and source of the driving transistor to cause the transistor to perform OFF operation even when the program signal is a positive voltage by supplying the common voltage while the capacitor element is being charged, which allows appropriate emission control in a low brightness region. Further, a conventional data drive circuit that outputs a program signal of positive voltage may be used without increasing power consumption.

DESCRIPTION OF THE PREFERRED EMBODIMENTS

Figure 1:
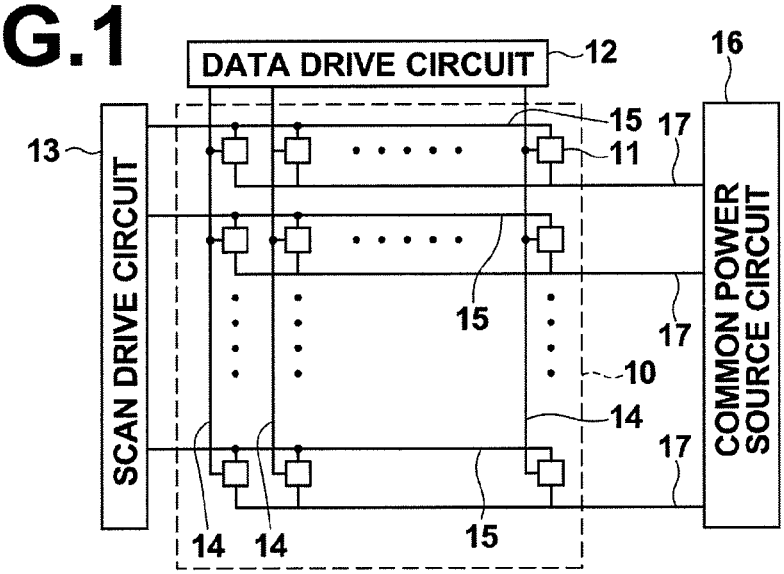
FIG. 1 is a schematic configuration diagram of an organic EL display device to which a first embodiment of the display apparatus of the present invention is applied.

Hereinafter, an organic EL display device to which a first embodiment of the pixel circuit and display apparatus of the present invention is applied will be described with reference to the accompanying drawings. FIG. 1 is a schematic configuration diagram of the organic EL display device to which the first embodiment of the present invention is applied.

As shown in FIG. 1, the organic EL display device according to the first embodiment of the present invention includes active matrix substrate 10 having multiple pixel circuits 11 disposed thereon two-dimensionally, each for holding charges according to a program signal outputted from a data drive circuit, to be described later, and applying a drive current to an organic EL element according to the amount of charges held therein, a data drive circuit 12 that outputs a program signal to each pixel circuit 11 of the active matrix substrate 10, a scan drive circuit 13 that outputs a scan signal to each pixel circuit 11 of the active matrix substrate 10, and common power source circuit 16 that supplies a common voltage to each pixel circuit 11 of the active matrix circuit 10.

Active matrix substrate 10 further includes multiple data lines 14, each for supplying the program signal outputted from data drive circuit 12 to each pixel circuit column, multiple scanning lines 15, each for supplying the scanning signal outputted from scan drive circuit 13 to each pixel circuit row, and multiple common power lines 17, each for supplying the common voltage outputted from common power source circuit 16 to each pixel row. Data lines 14 are provided orthogonal to scanning lines 15 and common power lines 17, forming a grid pattern. Each pixel circuit 11 is provided adjacent to the intersection of each data line 14 with each scanning line 15 and each common power line 17.

Figure 2:
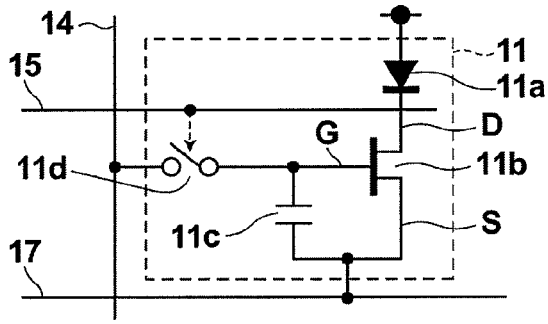
FIG. 2 is a pixel circuit of the organic EL display device to which the first embodiment of the display apparatus of the present invention is applied, illustrating the configuration thereof.

As shown in FIG. 2, each pixel circuit 11 includes organic EL element 11*a*, capacitor element 11*c* that stores charges according to the program signal outputted from data drive circuit 12, switching transistor 11*d* connected between the capacitor element 11*c* and data line 14 and performs ON/OFF operations based on the scanning signal outputted from scan drive circuit 13 to establish a short circuit connection between data line 14 and capacitance element 11*c* or to separate them from each other, and driving transistor 11*b* that receives, at gate terminal G, a voltage according to the amount of charges stored in capacitor element 11*c* and applies a drive current to organic EL element 11*a* connected to drain terminal D according to the voltage applied to the gate terminal.

Figure 3:
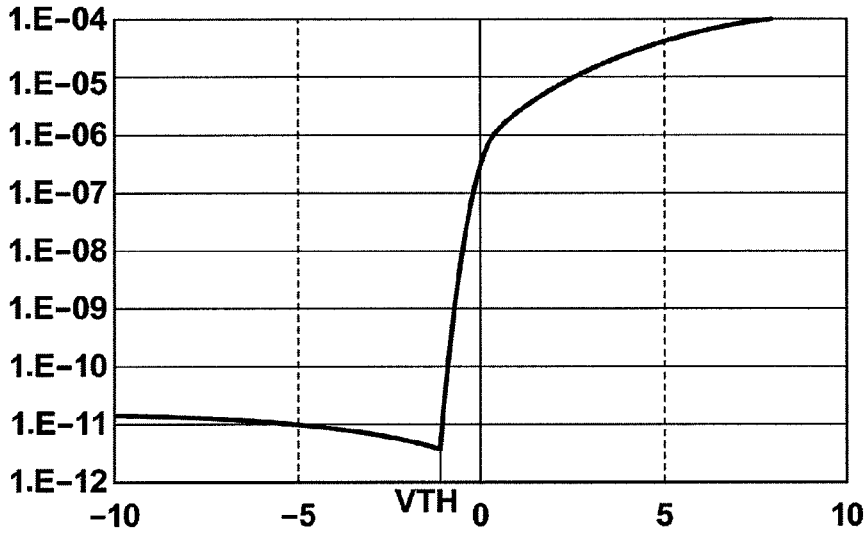
FIG. 3 shows one example characteristic of an inorganic oxide thin film transistor.

Driving transistor 11*b* and switching transistor 11*d* are inorganic oxide thin film transistors whose OFF-operation threshold voltage is a negative voltage. The term "OFF-operation threshold voltage" as used herein refers to gate-source voltage VGS at which drain current ID start increasing rapidly, and the term "OFF-operation threshold voltage is a negative voltage" as used herein refers to that the transistor has, for example, a VGS-ID characteristic like that shown in FIG. 3. The threshold voltage in the VGS-ID characteristic shown in FIG. 3 is VTH. As for the inorganic oxide thin film transistor, for example, a thin film transistor of inorganic oxide film made of IGZO (IngaZnO) may be used, but the material is not limited to IGZO, and ZnO and the like may also be used.

As shown in FIG. 2, source terminal S of driving transistor 11*b* and a second terminal of capacitor element 11*c* opposite to a first terminal thereof on the side of gate terminal G are connected to common power line 17.

Scan drive circuit 13 is a circuit that outputs ON-scan signal $V_{scan(on)}$ and OFF-scan signal $V_{scan(off)}$ for turning ON and OFF switching transistor 11*d* of pixel circuit 11 respectively.

Data drive circuit 12 is a circuit that outputs a program signal according to a display image to each data line 14.

Common power source circuit 16 is a circuit that supplies a common voltage to each common power line 17 with respect to each pixel circuit row.

An operation of the organic EL display apparatus of the present embodiment will now be described with reference to FIGS. 4 to 6.

Figure 6:
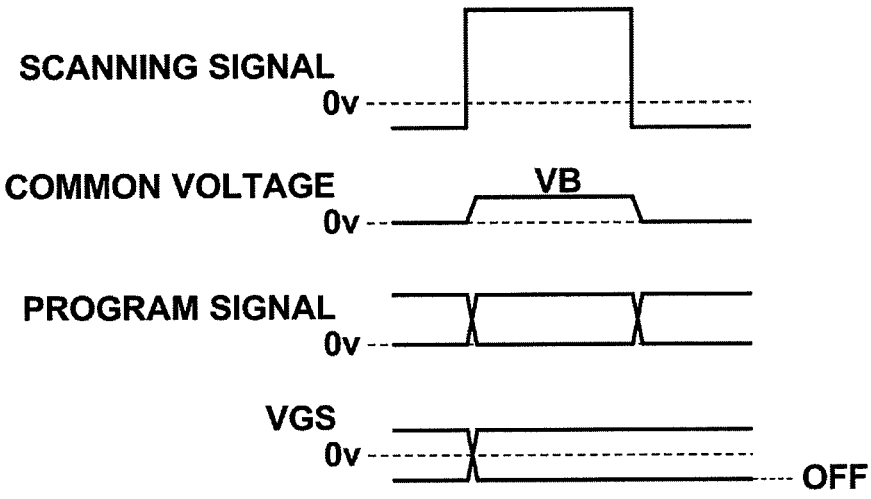
FIG. 6 illustrates voltage waveforms of scan signal and program signal, and a voltage waveform of gate-source voltage VGS of a driving transistor.

First, a predetermined pixel circuit row is selected by scan drive circuit 13, and an ON-scan signal like that shown in FIG. 6 is outputted to scanning line 15 connected to the selected pixel circuit row.

Figure 4:
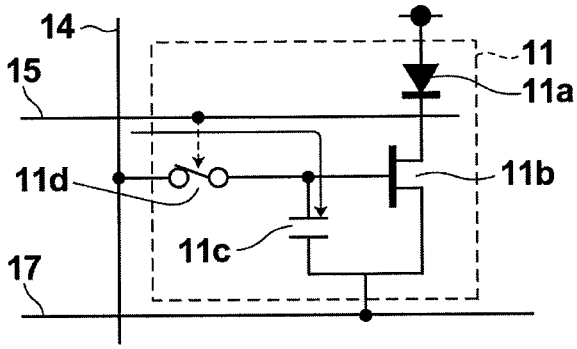
FIG. 4 illustrates charging operation of a capacitor element.

Then, as shown in FIG. 4, switching transistor 11*d* is turned ON in response to the ON-scan signal outputted from scan drive circuit 13, whereby short circuit connections are established between capacitor element 11*c* and data line 14, and between the gate terminal of driving transistor 11*b* and data line 14.

At the same time, a common voltage is supplied from common power circuit 16 only to common power line 17 connected to the pixel circuit row selected by scan drive circuit 13, and the potential of the common power line is raised from 0 v to VB, as shown in FIG. 6.

Further, at the same time when the predetermined pixel circuit row is selected and ON-scan signal is outputted, a program signal according to desired brightness of display pixel of each pixel circuit 11 of the selected pixel circuit row is outputted from data drive circuit 12 to each data line 14, and the program signal outputted to each data line 14 is inputted to each pixel circuit 11 of the selected pixel circuit row.

Here, if the gate-source voltage to be set for driving transistor 11*b* is assumed to be VGS in order to cause organic EL element 11*a* of each pixel circuit 11 to emit light of desired brightness, voltage value $V_{prg}$ of the program signal is set to $V_{prg}$=VGS+VB.

Consequently, charges according to voltage value $V_{prg}$ of the program signal set in the manner as described above is stored in capacitor element 11*c*. Here, if the voltage held by capacitor element 11*c* is assumed to be $V_{cs}$, then $V_{cs}=V_{prg}-VB=VGS$.

After the charging of capacitor element 11*c* is completed in the manner as described above, an OFF-scan signal is outputted from scan drive circuit 13 to scanning line 15 to which the selected pixel row is connected.

Figure 5:
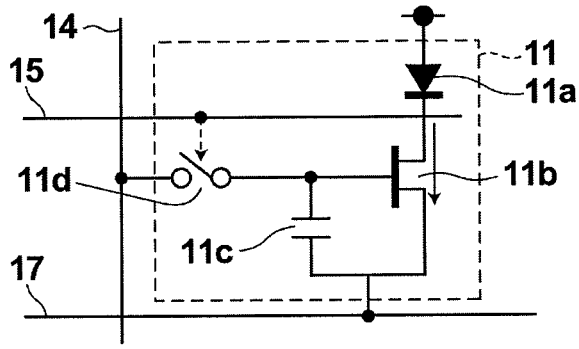
FIG. 5 illustrates holding and discharging operations of the capacitor element.

Then, switching transistor 11*d* is turned OFF in response to the OFF-scan signal outputted from scan drive circuit 13, as shown in FIG. 5, and capacitor element 11*c* and the gate terminal of driving transistor 11*b* are disconnected from data line 14.

At the same time when the selection of the predetermined pixel circuit row is released by the OFF-scan signal outputted from scan drive circuit 13, the potential of common power line 17 connected to the predetermined pixel circuit row is returned to 0 v from VB by common power source circuit 16. It is noted here that voltage $V_{cs}$ of capacitor element 11*c* is maintained as it is.

Then voltage $V_{cs}$ held by capacitor element 11*c* is applied to driving transistor 11*b* as gate-source voltage VGS, and a drive current flows through organic EL element 11*a* according to the applied voltage, whereby light is emitted from organic EL element 11*a*.

Here, voltage value $V_{prg}$ of the program signal outputted from data drive circuit 12 is, $V_{prg}>0$ v, so that minimum value $V_{csmin}$ of voltage value $V_{cs}$ settable to capacitor element 11*c* is, $V_{csmin}=-VB$.

Accordingly, in order to cause organic EL element to stop the emission, that is, to cause driving transistor 11*b* to perform OFF operation, it is necessary to set voltage value VB of the common voltage outputted to common power line 17 from common power source circuit 16 as $VB \geqq -VTH$, where VTH is the OFF operation threshold voltage of driving transistor 11*b*.

As described above, by setting the potential of common power line 17 greater than or equal to −VTH while capacitance element 11*c* is being charged, a negative voltage may be set as gate-source voltage VGS of driving transistor 11*b* when $V_{prg}>0$ v and driving transistor 11*b* may perform OFF operation, as shown in FIG. 6.

Thereafter, pixel circuit rows are sequentially selected by scan drive circuit 13, and charging and discharging of capacitance elements 11*c* are sequentially performed, whereby organic EL elements 11*a* sequentially emit light.

Where an inorganic oxide thin film transistor whose OFF-operation threshold voltage is a negative voltage is used also for switching transistor 11*d* as in pixel circuit 11 of the present embodiment, it is necessary to set the scanning signal supplied to switching transistor 11*d* to values shown below.

$$V_{scan(off)} \leqq VTH$$

$$V_{scan(on)} \geqq V_{prmax} + VTH$$

Thus, the scanning signal requires an amplitude ranging from a negative voltage to a positive voltage. Here, $V_{prgmax}$ is the voltage value of the program signal corresponding to maximum brightness of organic EL element 11*a*.

Figure 7:
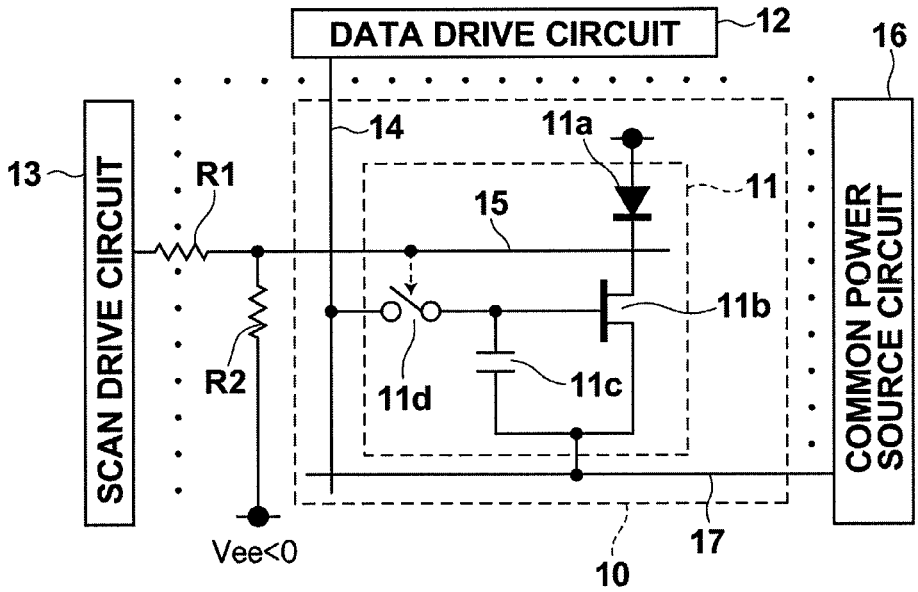
FIG. 7 is an additional circuit to the scan drive circuit when an inorganic thin film transistor whose OFF-operation threshold voltage is a negative voltage is used as the switching transistor, illustrating the configuration thereof.

As such, a scan drive circuit that outputs a positive voltage scanning signal may become usable by, for example, providing resistor elements R1 and R2 to each scanning line 15 connected to each pixel circuit row and a voltage source that supplies negative voltage $V_{ee}$, as shown in FIG. 7, and setting voltage $V_{ee}$ to a value that satisfies the condition described above.

Figure 11:
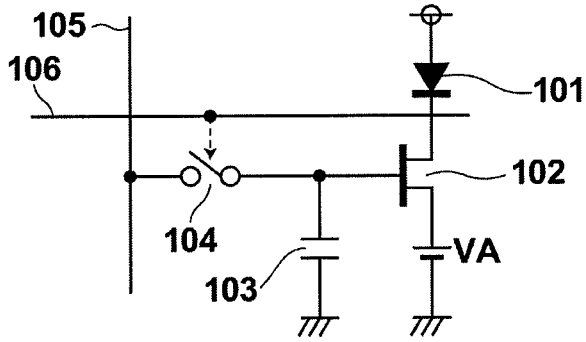
FIG. 11 illustrates the ground wire of a pixel circuit provided with a voltage source.

In the organic EL display apparatus according to the present embodiment, an inorganic oxide thin film transistor whose OFF-operation threshold voltage is a negative voltage is used as driving transistor 11*b*, so that power consumption is increased by the amount of common voltage VB supplied while capacitance elements 11*c* is being charged. But, in comparison with power consumption in the case where the ground wire of each pixel circuit is set to a voltage greater than 0 v, as shown in FIG. 11, common voltage VB is applied with respect to each pixel circuit row so that the power consumption may be reduced to 1/number of scanning lines. Therefore, the increase in power consumption is minor in comparison with the overall power consumption of the display apparatus.

Next, an organic EL display device to which a second embodiment of the pixel circuit and display apparatus of the present invention is applied will be described. The organic EL display device according to the second embodiment of the present invention differs from the organic EL display device according to the first embodiment of the present invention in the configuration of pixel circuit, although the general structure is identical to that of the organic EL display device of the first embodiment shown in FIG. 1.

The pixel circuit of the second embodiment differs from the pixel circuit of the first embodiment in the position of the organic EL element. Whereas, in pixel circuit 11 according to the first embodiment, the cathode terminal of organic EL element 11*a* is connected to the drain terminal of driving transistor 11*b*, the anode terminal of organic EL element 11*a* is connected to the source terminal of driving transistor 11*b* in pixel circuit 21 according to the second embodiment, as shown in FIG. 8.

Figure 8:
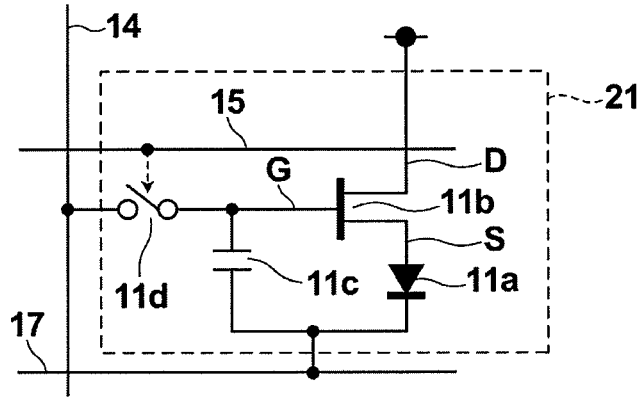
FIG. 8 is a schematic configuration diagram of an organic EL display device to which a second embodiment of the display apparatus of the present invention is applied.
Figure 9:
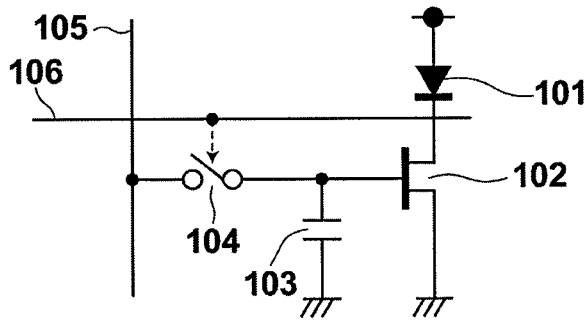
FIG. 9 illustrates a conventional pixel circuit, illustrating the configuration thereof.
Figure 10:
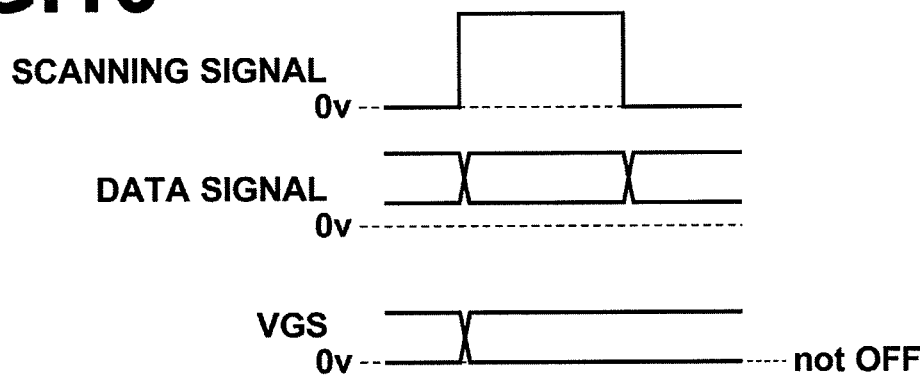
FIG. 10 illustrates voltage waveforms of scan signal and data signal, and a voltage waveform of gate-source voltage VGS of the driving transistor of the conventional display device.

In addition, as shown in FIG. 8, the cathode terminal of organic EL element 11*a* and a second terminal of capacitor element 11*c* opposite to a first terminal thereof on the side of gate terminal G are connected to common power line 17.

Other configurations of pixel circuit 21 are identical to those of pixel circuit 11 according to the first embodiment.

The operation of the organic EL display device according to the second embodiment is identical to that of the organic EL display device according to the first embodiment. But, it is necessary to set voltage value $V_{prg}$ of the program signal outputted from data drive circuit 12 so as to satisfy the formula below.

$$V_{prg} = VGS - VB + Vf$$

where, Vf is the forward voltage drop across organic EL element 11*a* when the gate-source voltage of driving transistor 11*b* is VGS.

Each of the embodiments of the present invention described above is an embodiment in which the display apparatus of the present invention is applied to an organic EL display device. But, as for the light emitting element, it is not limited to an organic EL element and, for example, an inorganic EL element or the like may also be used.

The display apparatus of the present invention has many applications. For example, it is applicable to handheld terminals (electronic notebooks, mobile computers, cell phones, and the like), video cameras, digital cameras, personal computers, TV sets, and the like.

What is claimed is:

1. A display apparatus comprising:

pixel circuits, each equipped with: a light emitting element; a driving transistor, with a drain terminal thereof connected to a cathode terminal of the light emitting element, that applies a drive current to the light emitting element; a capacitor element connected to a gate terminal of the driving transistor; and a switching transistor connected between a first terminal of the capacitor element on the side of the gate terminal and a data line through which a desired program signal flows;

an active matrix substrate in which a great number of the pixel circuits, in which the drive transistors are inorganic oxide thin film transistors having a negative voltage as a threshold voltage for an OFF operation are arranged;

a data driving circuit for supplying the program signal; and a common power source for supplying a predetermined common voltage to a source terminal of the driving transistor and a second terminal of the capacitor element; wherein the voltage value Vprg of the program signal satisfies the condition: Vprg≧0;

the common power source supply the common voltage when the switching transistor is turned ON and a voltage value Vprg of the program signal is applied to the gate terminal of the driving transistor;

the common voltage VB and the threshold voltage VTH of the driving transistor are set to values that satisfy the condition: VB≧−VTH.

2. The display apparatus of claim 1, wherein the switching transistor is an inorganic oxide thin film transistor whose OFF-operation threshold voltage is a negative voltage.

3. The display apparatus of claim 1, wherein the common power source supplies a zero voltage as the common voltage when the switching transistor is turned OFF.

4. The display apparatus of claim 1, wherein the driving transistor is constituted by a metal oxide that includes at least one metal element from among In, Ga, and Zn.

5. A pixel circuit, comprising:

a light emitting element; a driving transistor, with a source terminal thereof connected to an anode terminal of the light emitting element, that applies a drive current to the light emitting element; a capacitor element connected to a gate terminal of the driving transistor; and a switching transistor connected between a first terminal of the capacitor element on the side of the gate terminal and a data line through which a desired program signal flows;

an active matrix substrate in which a great number of the pixel circuits, in which the drive transistors are inorganic oxide thin film transistors having a negative voltage as a threshold voltage for an OFF operation are arranged;

a data driving circuit for supplying the program signal; and a common power source for supplying a predetermined common voltage to a cathode terminal of the light emitting element and a second terminal of the capacitor element; wherein the voltage value Vprg of the program signal satisfies the condition: Vprg≧0;

the common power source supplies the common voltage when the switching transistor is turned ON and the voltage value Vprg of the program signal is applied to the gate terminal of the driving transistor; and the common voltage VB and the threshold voltage VTH of the driving transistor are set to values that satisfy the condition: VB≧−VTH.

6. The pixel circuit of claim 5, wherein the switching transistor is an inorganic oxide thin film transistor whose OFF-operation threshold voltage is a negative voltage.

7. The pixel circuit of claim 5, wherein the common power source supplies a zero voltage as the common voltage when the switching transistor is turned OFF.

8. The pixel circuit of claim 5, wherein the driving transistor is constituted by a metal oxide that includes at least one metal element from among In, Ga, and Zn.

* * * * *